US006007168A

United States Patent [19]

Gaide

[11] Patent Number: 6,007,168

[45] Date of Patent: Dec. 28, 1999

[54] DISPENSER OF HAND-DRYING STRIPS OF MATERIAL

[75] Inventor: Albert Gaide, Monnaz, Switzerland

[73] Assignee: CWS International AG, Baar, Switzerland

[21] Appl. No.: 08/945,117

[22] Filed: Oct. 16, 1997

[30] Foreign Application Priority Data

Apr. 19, 1995 [CH] Switzerland ..... 1122/95
Apr. 9, 1996 [CH] Switzerland ..... 919/96

[51] Int. Cl.[6] ..... B65H 19/00; A47K 10/28

[52] U.S. Cl. ..... 312/34.6; 312/34.5

[58] Field of Search ..... 312/34.1, 34.4, 312/34.5, 34.6

[56] References Cited

U.S. PATENT DOCUMENTS 1,598,921 9/1926 Marshall et al. ..... 312/34.5
1,849,063 3/1932 Belenson ..... 312/34.6
1,860,206 5/1932 Schwartz ..... 312/34.6

FOREIGN PATENT DOCUMENTS 227860 7/1987 European Pat. Off. .
8203720 4/1984 Netherlands ..... 312/34.4
203299 4/1924 United Kingdom ..... 312/34.5

*Primary Examiner*—Peter R. Brown
*Assistant Examiner*—James O. Hansen
*Attorney, Agent, or Firm*—Schweitzer Cornman Gross & Bondell LLP

[57] ABSTRACT

A process and a device for dispensing portions of a continuous strip of towel provides that the strip of material is guided from a clean area into a used area at the back of the apparatus. The position or height of a corresponding partition between the areas may be controlled. The stock of clean strip of material is preferably monitored and when it is spent, the remaining strip of material is drawn in a defined manner, preventing the towel from being accidentally reused. In one embodiment, the strip of material is folded in both areas and is thus easy and hygienic to handle. A system with cassettes that may be exchanged as a whole is also disclosed.

8 Claims, 11 Drawing Sheets

DISPENSER OF HAND-DRYING STRIPS OF MATERIAL

Figure 1:
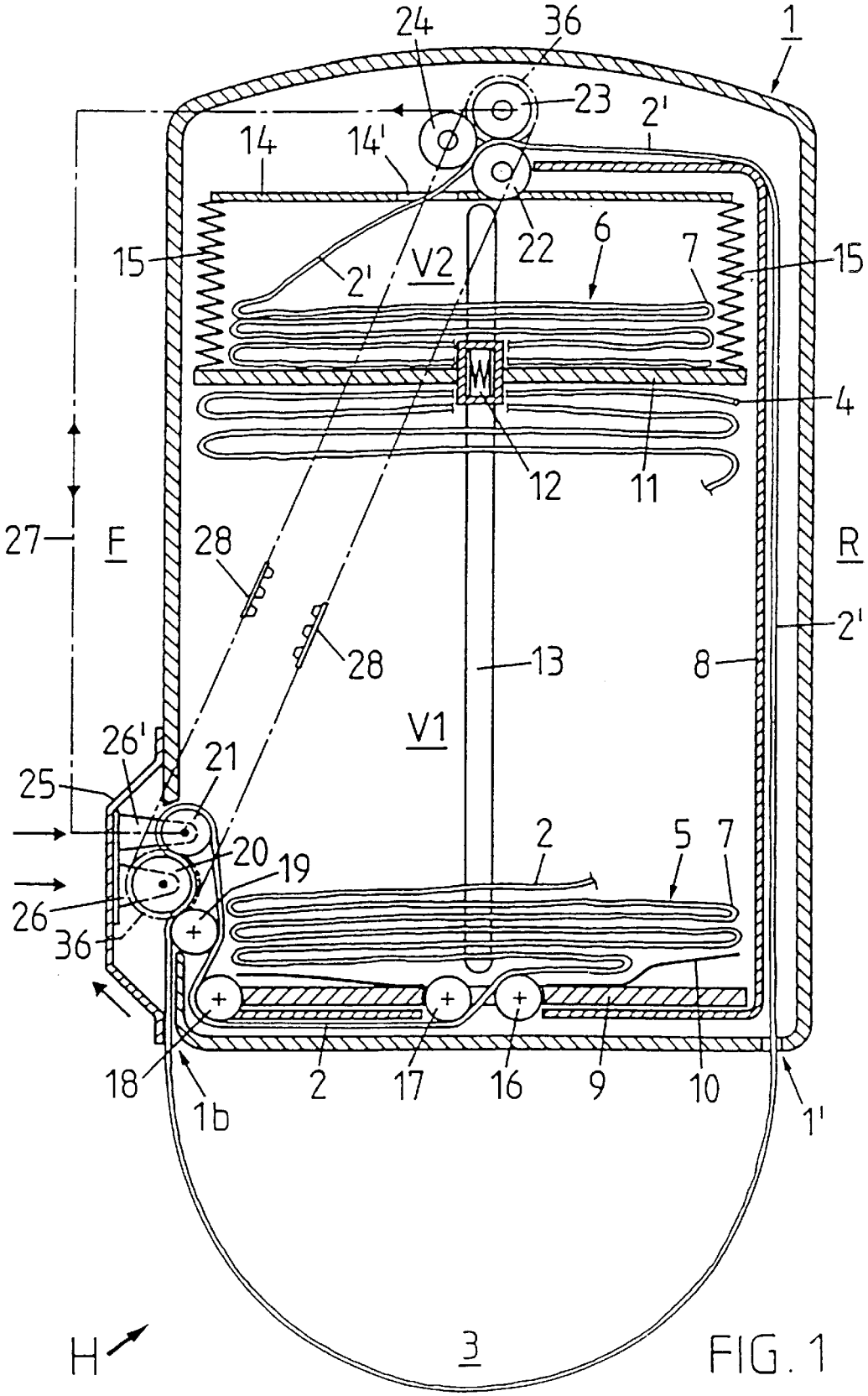

The present invention relates to a method for dispensing a flat and absorbent strip material for hand drying, in which, in an apparatus housing, a first partial volume for receiving and storing a stock of clean, ready-to-use strip material is provided and a second partial volume for receiving used strip material is provided, the two partial volumes are separated from one another by a displaceable partition and the strip material forms a loose loop, the said strip material being transferred from the first partial volume, in manually initiated fashion, at intervals and synchronously into the second partial volume, and the used strip material being transported outside the two partial volumes, on the side facing away from the user, with formation of a loop.

A device for carrying out the method is also the subject matter of the invention.

A method according to the precharacterizing clause of claim 1 is known from EP-A1-0 227 860. The implementation of this method in a towel dispenser leads to appliances of large overall height and moreover only allows the use of strip material of relatively short length. Consequently, this dispenser is unsuitable for applications with frequent usage, for example in public washrooms.

Also commonly known are towel dispensers having towel rolls which are inserted in the form of clean cloth rolls into an apparatus and are removed as used, dirty rolls and taken for washing. These towel dispensers are generally designed such that inadvertent multiple use of the same portion of cloth cannot take place; in particular, the end of the strip material must not hang from the apparatus in freely accessible fashion.

Similarly, absorbent and tear-resistant paper strips are also used nowadays instead of cloth, these being removed from the dispenser after usage and burnt.

The known methods and devices have the disadvantage that they are relatively uneconomical and often unhygienic from the point of view of their handling, that they utilize the available space poorly and that they are costly and/or complicated both from the point of view of their production and their upkeep.

It is therefore the object of the invention to provide a method and a device which utilize the available space optimally and ensure simplified handling, in particular when exchanging the strip material.

In addition, the invention is to permit simplification and cost reduction of the logistics with regard to the operation and upkeep of the dispensers. When the used strip material is transported back to a laundry, it is to be touched as little as possible by the staff; moreover, it is to be easily transportable and require only a small storage space.

The subject matter of the invention is in addition to take account of the wide variation in the quality and the particular state of the strip material. In particular, it is to be able to transport and store even long and sewn-together strips without problems, so that its, as far as possible, uninterrupted use in frequently used public washrooms is ensured.

This object is achieved according to the invention in that the displaceable partition is controlled in its position, in dependence on the degree of fullness in the second partial volume, in such a way that this partial volume increases to receive further used strip material.

The method according to the invention allows the construction of compact towel dispensers in a wide variety of alternative designs, including their modular construction.

The degree of fullness referred to in the claim is defined by the amount of strip material present in the respective partial volume in relation to the maximum-possible amount; the maximum degree of fullness is based on the functional shape of the strip material and not on the highest-possible packing density. The maximum degree of fullness is thus dependent on the wound shape of the strip material, but also on the strip material itself, for example on its quality, degree of wear, moisture content, etc.

The subject matter of the invention can be easily combined with proven mechanisms, known per se, for determination of the interval, or the accessible strip length per use.

The corresponding device is distinguished in that a spindle is provided which is driven by a servomotor and controls the partition in its position by way of a threaded nut.

Preferred developments of the invention are described in dependent claims which follow.

The control of the volumes according to claim 2 can be realized in its simplest form by way of the forces occurring in the second partial volume.

In this regard, the arrangement of the volumes one above the other, which is known per se, is favourable, since the lowering of the bottom required therefor is particularly simple, claim 3.

A stepwise displacement of the partition, cf. claim 4, increases the operational reliability.

The movable element according to claim 5, which, realized in the simplest form, has the effect of a measuring element, has proved to be particularly successful.

A positional control according to claim 6 allows the incorporation of microprocessors and serves to achieve a maximum packing density of used strip material in the second partial volume.

The monitoring of the presence of clean strip material increases the operational reliability and prevents the said strip material from becoming a "multiple-use towel", claim 7.

An improvement of the control by means of a spindle drive according to claim 8 includes, according to claim 9, a belt, for example a toothed belt, to which the partition can be very easily joined. Similarly, Velcro fasteners could be used.

A further toothed belt, claim 10, ensures non-slip transmission of the kinetic energy.

claim 11 relates to a favourable positioning of the rollers with minimal displacement paths needed for drawing in the strip end.

The refinement according to claim 12 describes a very simple means of initiating the displacement of the rollers for drawing in the strip end; only a small expenditure of force is need with this.

Particularly advantageous is the solution according to claim 13, in which the energy required for the drawing-in is stored in the interior of a roller and is released at the correct time.

By folding the strip material according to claim 14, the volumes can be optimally utilized. The storage space in the case of storage and during transportation is also reduced.

The folding container according to claim 15 is particularly hygienic and facilitates the pushing-back of dirty material. In addition, it prevents soiling in the apparatus housing.

By incorporating a laterally guided, height-adjustable bottom plate, claim 16, control of its position in a manner free from jamming is ensured.

Particularly simple is the temporary storage of the energy for drawing in the strip end according to claim 17.

By virtue of the arrangement of toothed wheels on both sides according to claim 18, the force transmissions can be optimally realized—by toothed belt.

According to claim 19, a single, easily exchanged cassette accommodates both partial volumes, i.e. the clean and the used strip material.

It is kinematically advantageous to arrange merely three rollers in the cassette, claim 20.

By virtue of the design according to claim 21, a weight reduction can be achieved for the transportation of the cassettes to and from the laundry; in addition, transport damage to the mechanism can be avoided.

It is advisable to envelop the used strip material, claim 22, thereby avoiding the need for premature cleaning of the cassette.

Particularly simple and economical is the embodiment of the cassette according to claim 23; the small space requirement allows its assembly even in a laundry.

Figure 2:
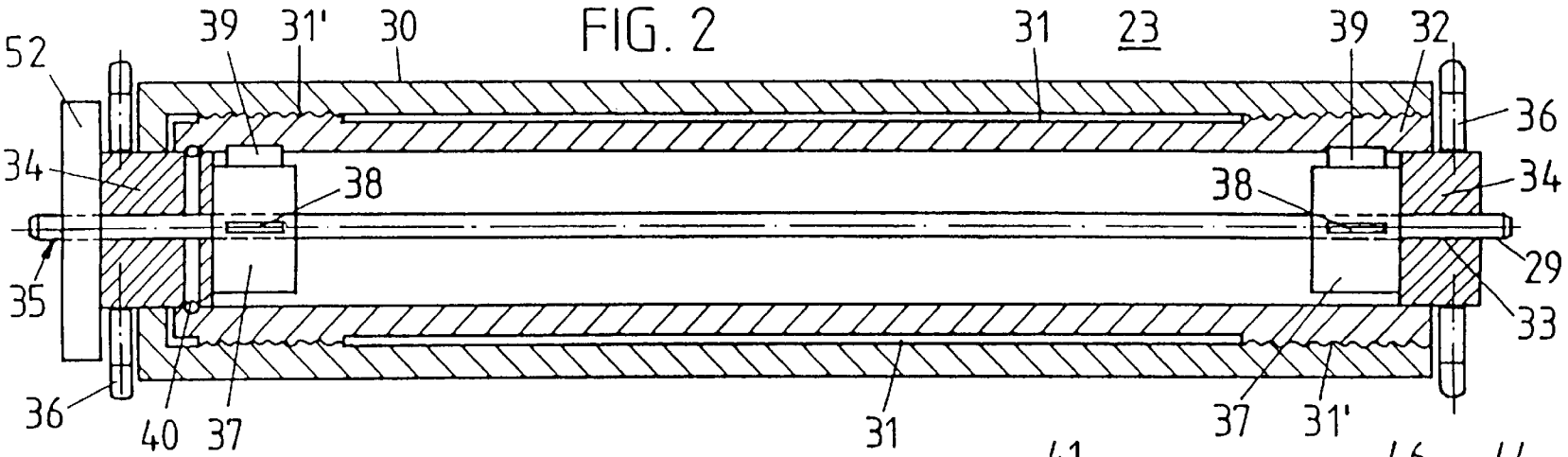
Figure 4:
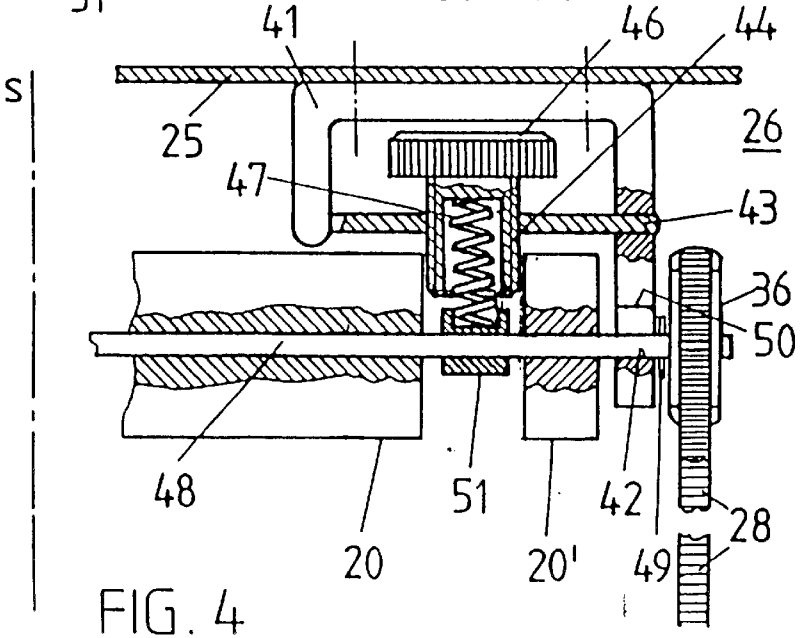
Figure 3:
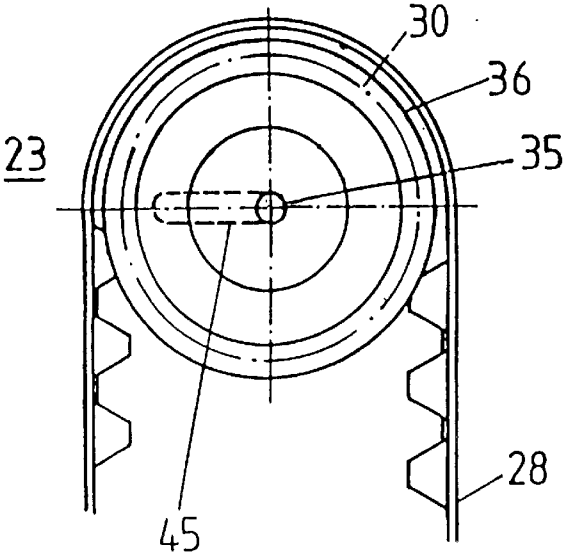
Figure 5:
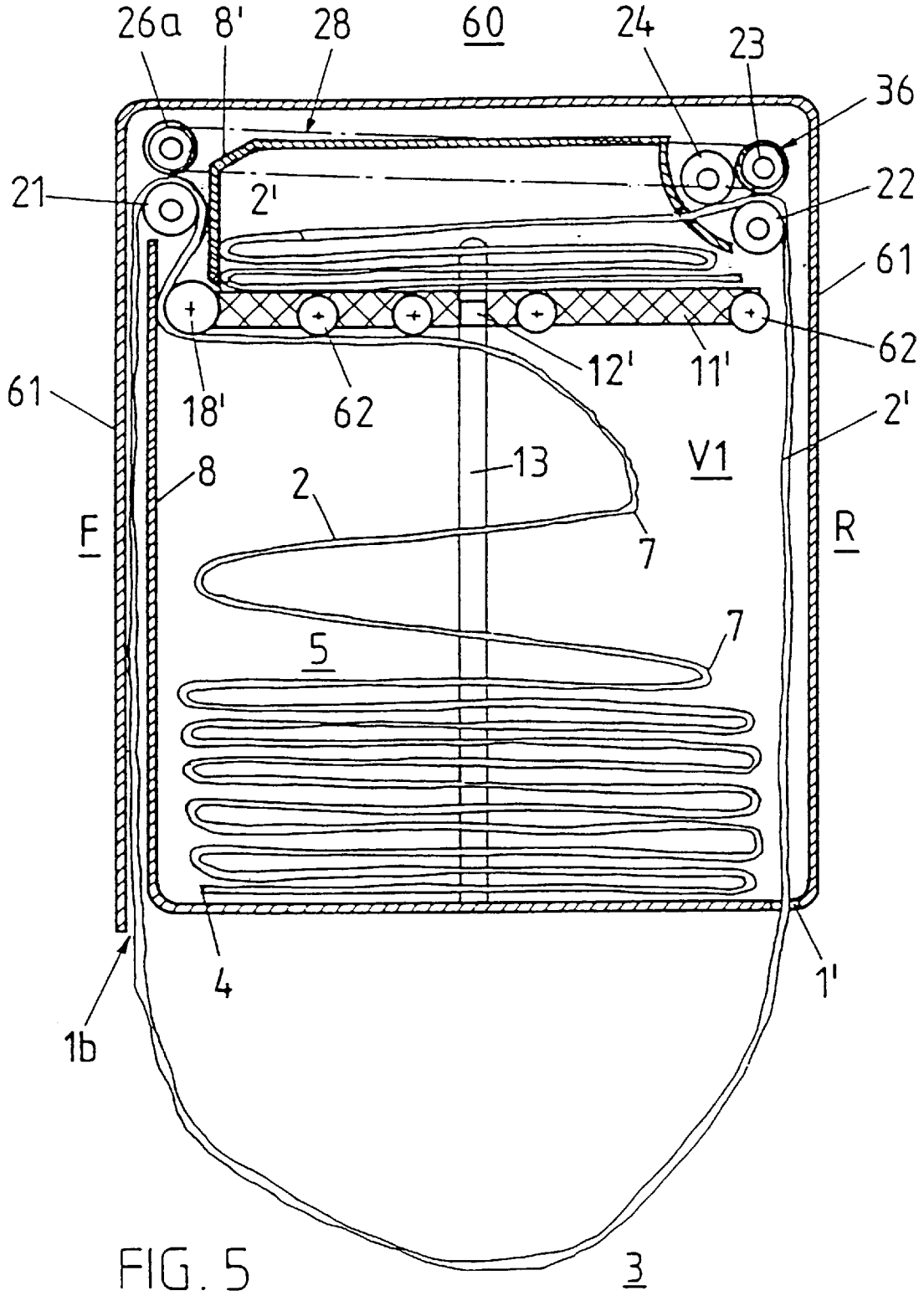
Figure 6:
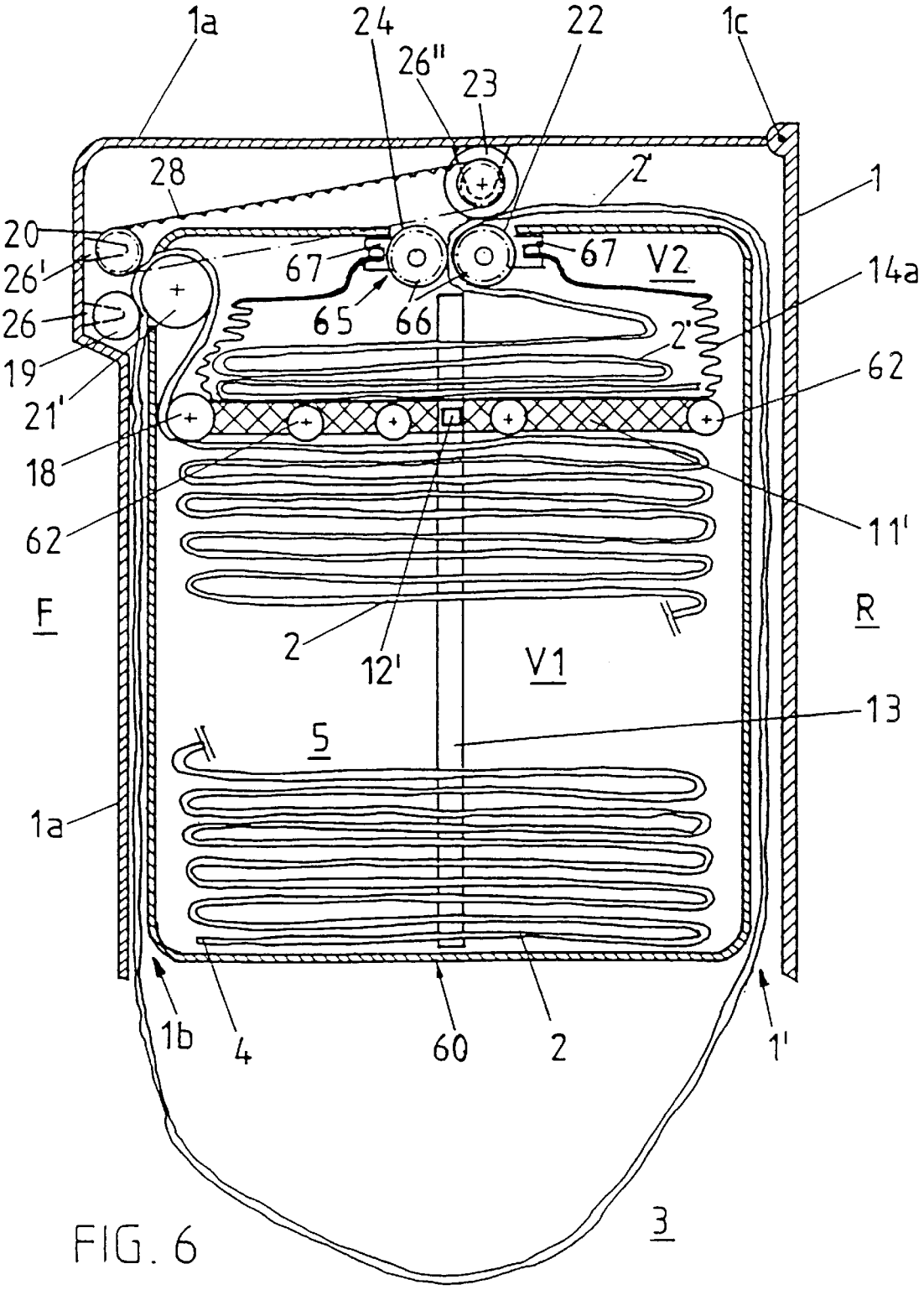
Figure 7:
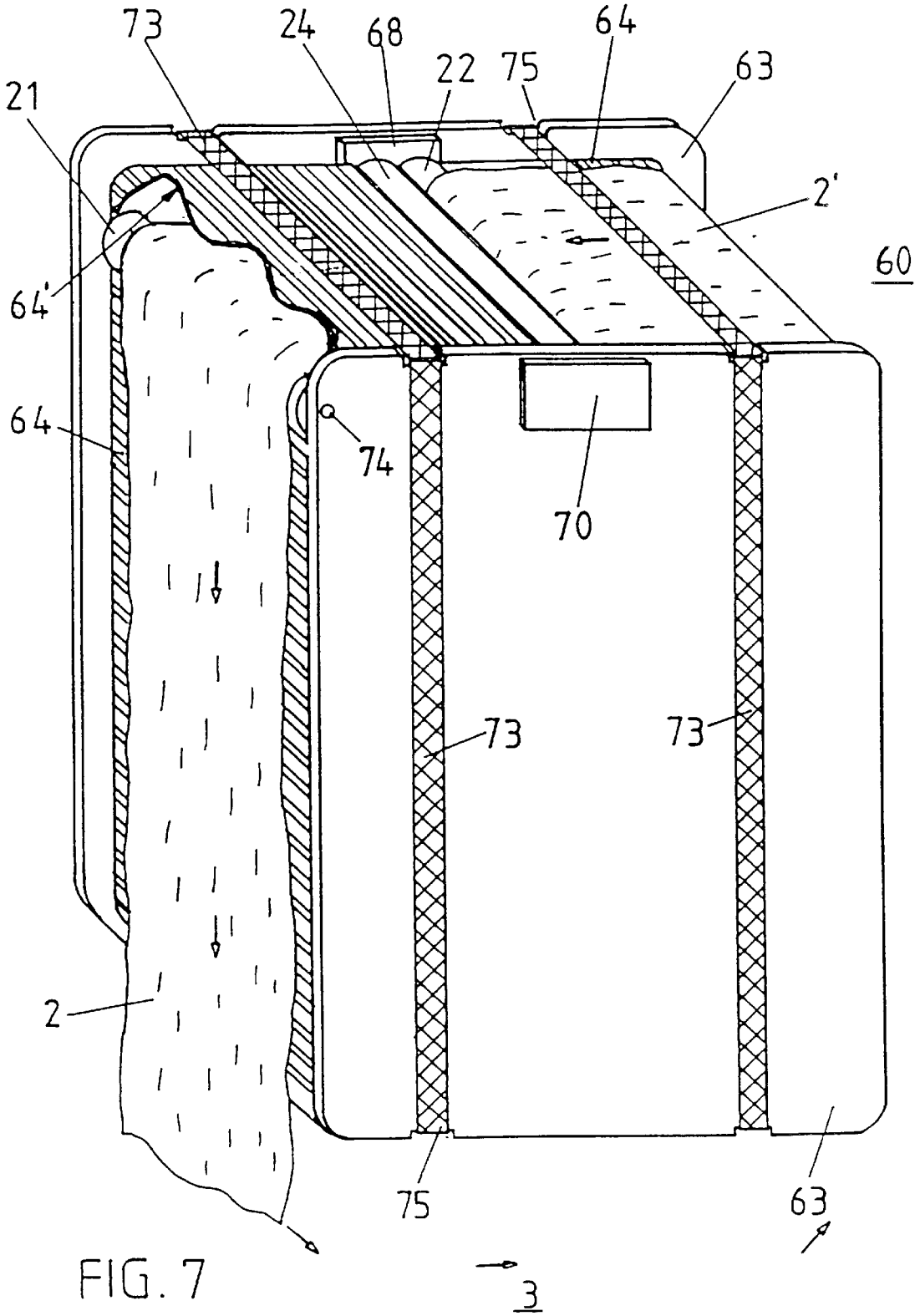
Figure 8:
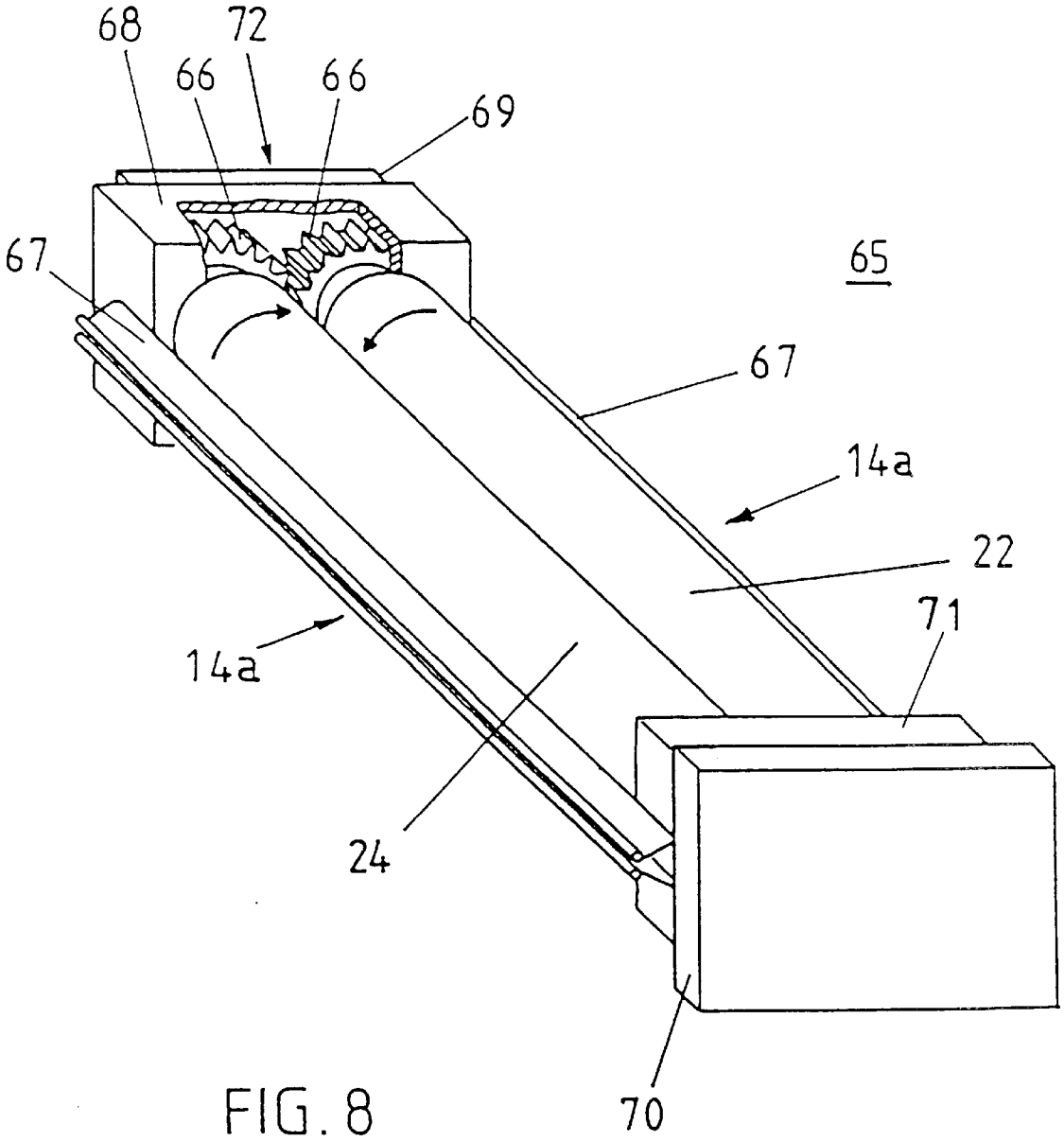
Figure 9:
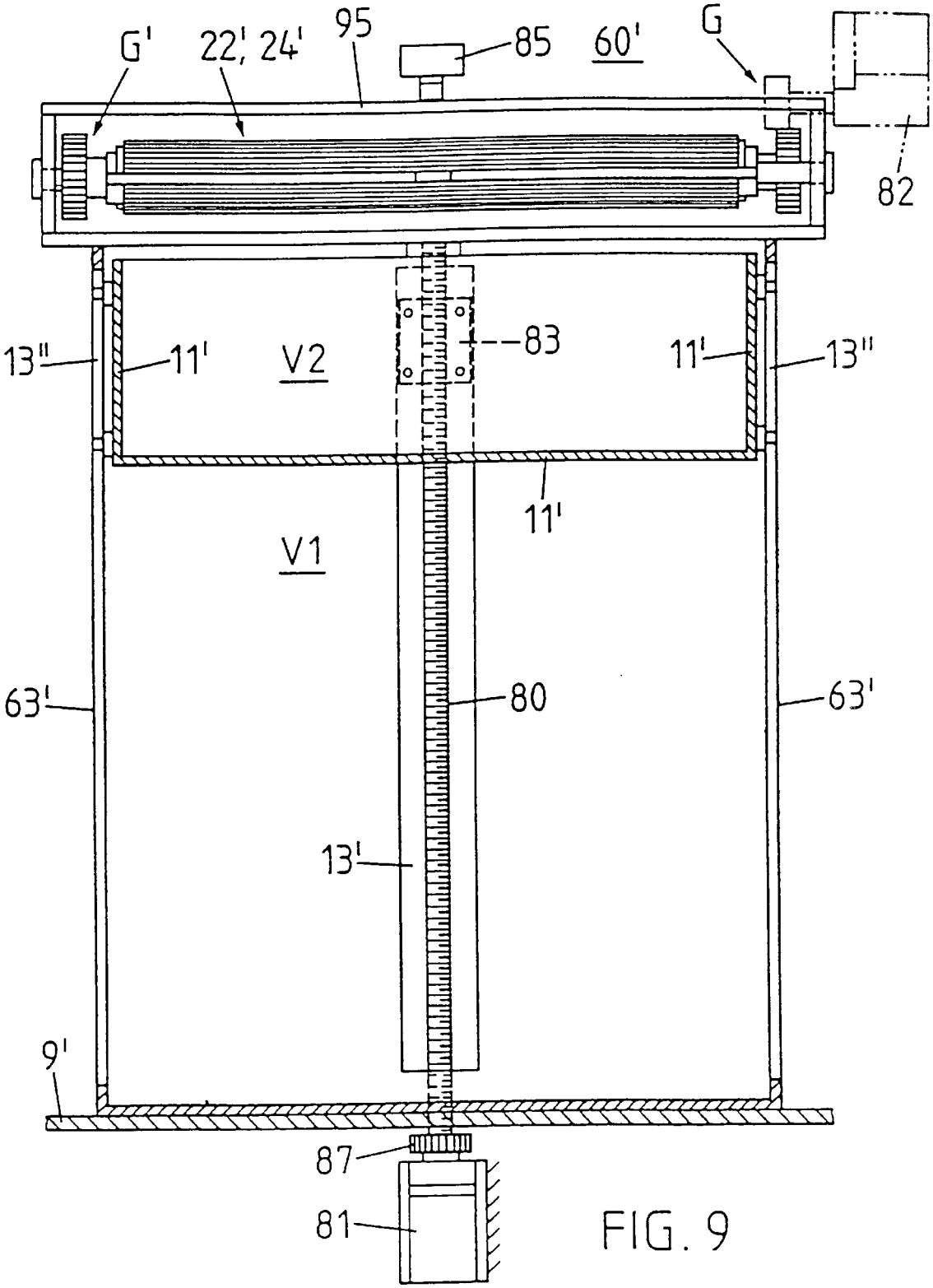
Figure 10:
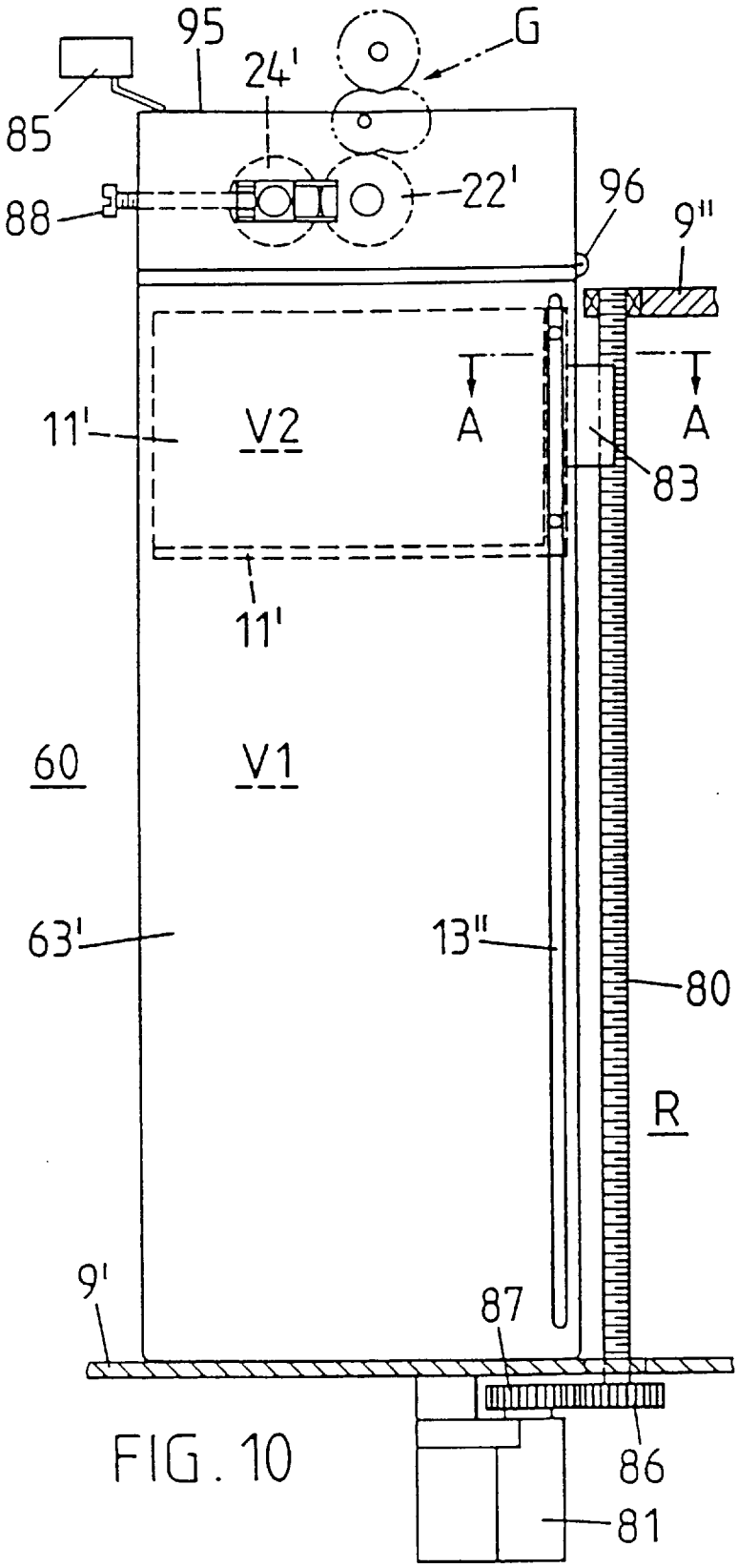
Figure 10A:
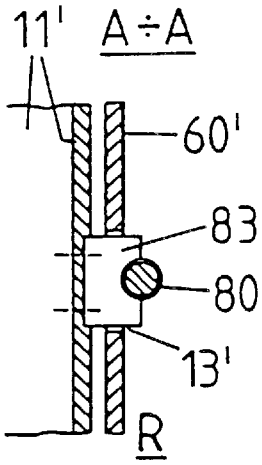
Figure 11:
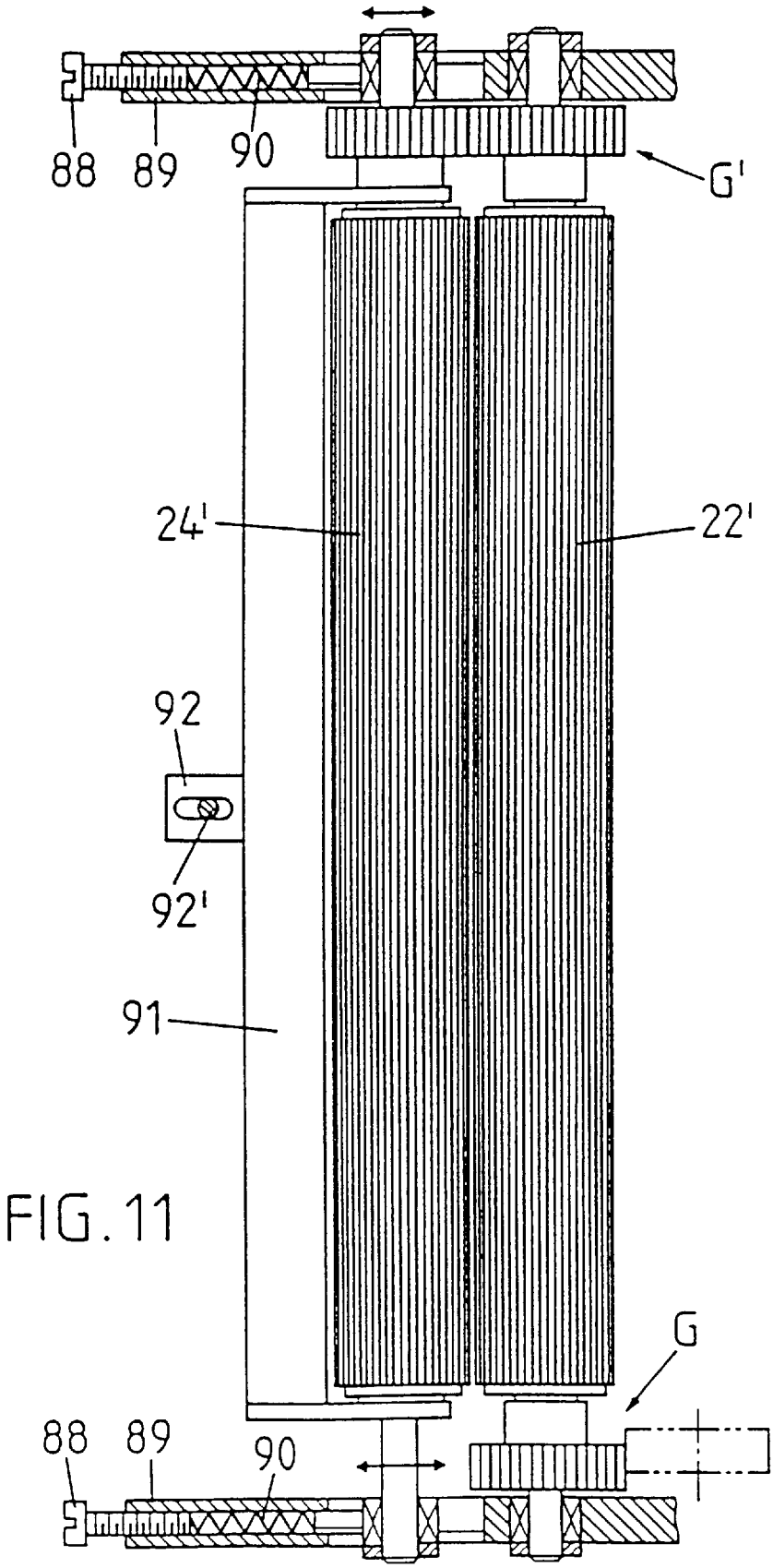
Figure 13:
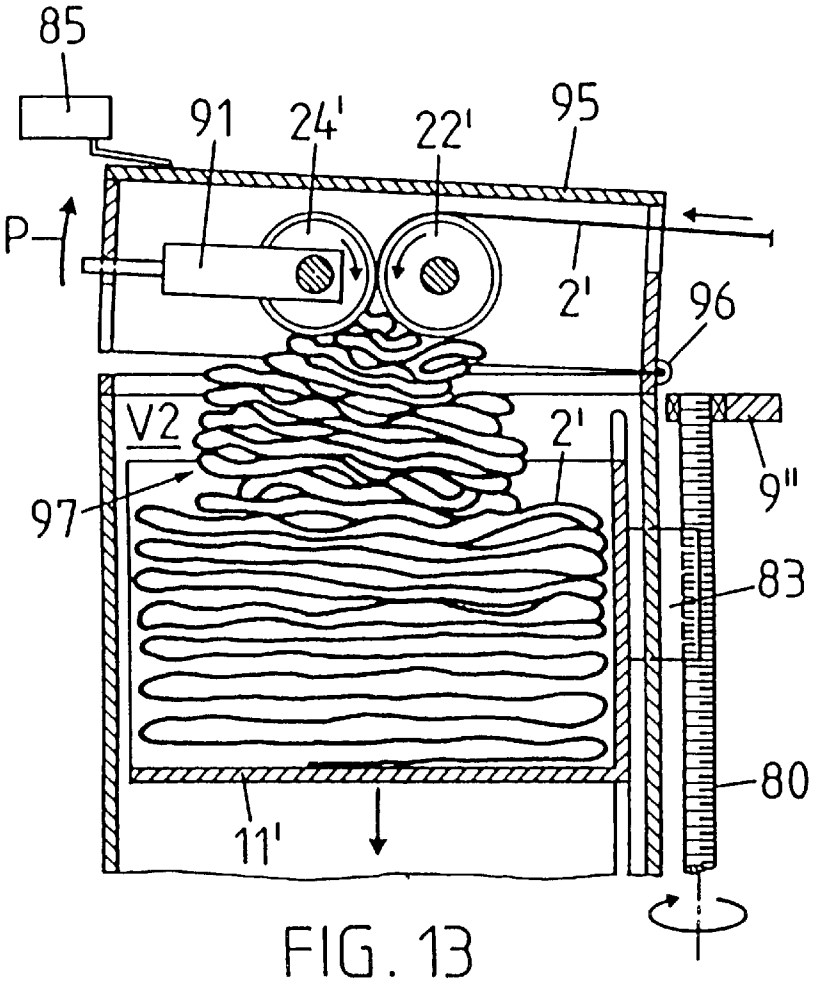
Figure 12:
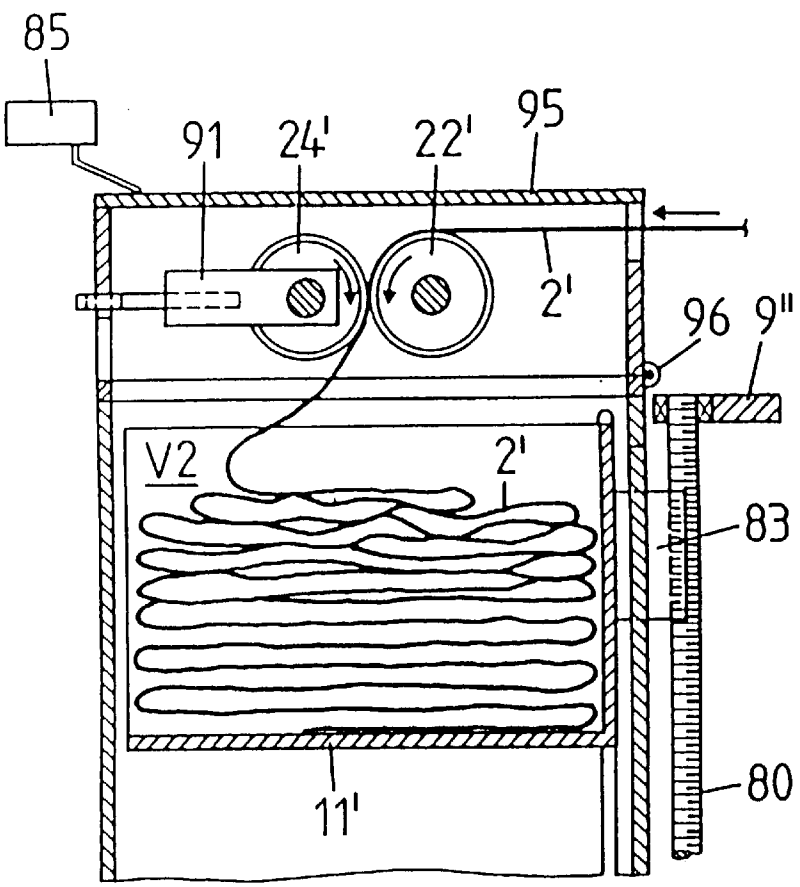
Figure 14:
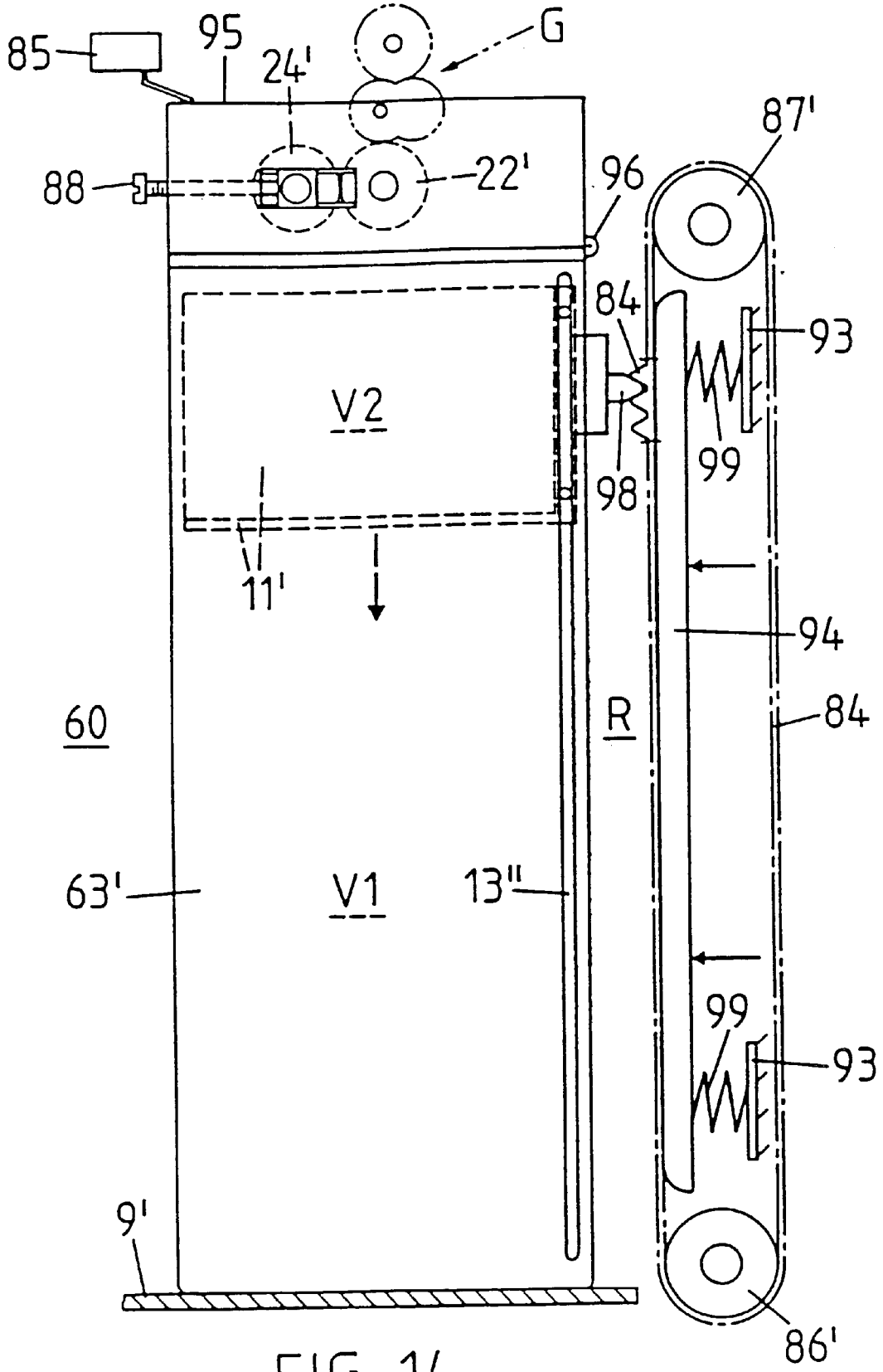

Several exemplary embodiments of the invention are described in greater detail below with reference to drawings, in which:

FIG. 1 shows a towel dispenser in a lateral sectional representation, with a simplified, force-controlled lowering of the bottom, FIG. 2 shows a roller with integrated energy storage for drawing in the strip end, FIG. 3 shows the roller of FIG. 2 in a lateral view, with a fitted belt in addition, FIG. 4 shows a resiliently designed roller pair for the transmission of the kinetic energy, FIG. 5 shows the basic principle of a self-contained changeable cassette for receiving and transporting the strip, in a sectional representation, FIG. 6 shows a further-developed cassette with a folding container in an apparatus housing with hinged cover, FIG. 7 shows a further cassette in a perspective representation, in the functioning state, outside an apparatus housing, FIG. 8 shows the upper roller pair from FIG. 7 as a plug-in unit, FIG. 9 shows a spindle drive for lowering the partition between the two partial volumes, seen from the front in a partial-sectional representation, FIG. 10 shows the spindle drive of FIG. 9, in an apparatus housing represented in simplified form, seen from the side, FIG. 10*a* shows the spindle with threaded nut from FIG. 10, seen from above, FIG. 11 shows the upper-side transporting rollers according to FIG. 9 in a detailed representation, FIG. 12 shows a movably arranged element for establishing the degree of fullness in the upper partial volume, FIG. 13 shows the mode of action of the element of FIG. 12 when a preset degree of fullness is reached, and FIG. 14 shows a variant of a control for the lowerable partition by means of toothed-belt drive.

In FIG. 1, an apparatus housing is denoted by 1 and has a front side F and a rear side R suitable for mounting on a wall. Situated in the apparatus housing 1, the outer wall of which is vertically sectioned, is the strip material 2 provided for the hand drying. The said strip material is transferred, in the form of a loop 3, from a first partial volume V1 having a clean stack 5 of material 2, with folds 7, by way of a passage 1', behind an inner wall 8 and into a second partial volume V2 which contains a stack 6 comprising dirty strip material 2'.

The stack 5 rests on a covering 10 which in turn is fixed on a bottom plate 9. The clean strip material 2 is guided between two rubberized sliding rollers 16 and 17 through an opening in the bottom plate 9 and upwards by way of rollers 18, 19 and 21 of the same type, before forming a loop 3 below a passage 1*b*. Situated between the rollers 19 and 21 is a roller 20 which is displaceable in axially parallel fashion and is spring-mounted in a support 26 resting on an outer covering 25.

The dirty strip material 2' is guided above the partial volume V2, likewise on rollers 22 to 24, and slides through an opening 14' into a folding container 14 with bellows 15.

With increasing use, the second partial volume V2 increases at the expense of the first partial volume V1, i.e. a partition 11, which at two mutually opposite end faces has in each case a friction block 12 with spring and is guided and braked thereby in guiding slots 13 arranged on both sides, slides vertically downwards and opens the bellows 15 in accordance with the increasing space requirement of the used strip material 2'.

For graphical reasons, the friction block 12 is shown without spring.

By virtue of this positional control of the partition 11, the degree of fullness in the partial volume V2 is kept approximately constant; the increasing weight of the filled-in strip material is compensated by the progressive spring action of the bellows 15.

Serving to transport the dirty strip material 2' into the folding container 14 is the roller 23 which is driven by a toothed belt 28 which in turn engages in a toothed wheel 36 on the roller 20 and wraps around the said toothed wheel.

The roller 23 is arranged to be horizontally displaceable and is coupled by an operative connection 27 to the roller 21 which is designed, mounted in a support 26', to be capable of being shifted in likewise horizontally (towards the right in the direction of the arrow).

In a dispenser to be put into operation anew, a bound cloth-towel stack is inserted into the lower partial volume V1 of the apparatus housing, for example through a covering which is to be opened laterally. By cutting open the binding, one end of the strip material 2 can be pushed through between the rollers 16, 17; at the left-hand inner edge of the apparatus housing 1, the strip material 2 then slides through between the rollers 18 and 19 and can be gripped there. Thereafter, it is guided around the roller 21, and the roller 20 is pushed outwards in axially parallel fashion; the strip 2 is guided downwards in front of the roller 19 through an open gap and pulled until a sufficiently large loop 3 for the hand drying forms, cf. FIG. 1. Thereupon, the strip material 2 is pushed up between the inner wall 8, serving as a guiding wall, and the outer wall of the apparatus housing 1 and drawn through between the rollers 22, 23 and 24 so that the end reaches into the folding container 14.

As a result of this "threading procedure", the roller 20 with the sprocket 36 fastened thereon has been rotated so that, by way of the toothed belt 28, the analogous sprocket wheel 36 with the roller 23 has likewise rotated.

Springs, described below in FIG. 2, which are present in the roller 23 bring about a storage of the energy of the transmitted rotary movement.

In the operation of the dispenser, clean strip material can be pulled in each case from the position H (=hand), by way of a distance-and/or time-limiting means, known per se. The advancing of strip material 2 is transferred in the same way, by way of the toothed belt 28, to the pushing-in of dirty or wet material 2' into the folding container 14, so that the loop 3 retains its constant size.

Through the constant use of the dispenser, the entire strip material 2, which initially is situated in the partial volume V1, is supplied as dirty material 2' to the folding container 14 in a hygienically perfect manner.

The resiliently designed roller 20, described in greater detail below in FIG. 4, and the roller 21 of the same construction establish, in a simple way, the presence of strip material (see FIG. 1):

If it is absent, both rollers are deflected on their spring excursion. The deflection of the roller 21 is transmitted by a double-armed lever 27, depicted here outside the apparatus housing 1 for reasons of presentation, to the roller 23, so that the latter loses its friction with the cloth strip 2' and now comes into contact with the roller 24. As a result, the spring, which was previously tensioned in the clockwise direction, is unloaded; the said spring transmits the resultant rotary movement of the roller—in the anti-clockwise direction—to the roller 24, so that the portion which was previously hanging out of the apparatus 1 is drawn in up to its strip end 4, that is to say is "supplied" to the folding container 14 through the two rollers 22 and 24.

Further details of this solution are described by way of example below with reference to FIGS. 2 to 4, identical reference numerals being used for identical functional parts.

According to FIG. 2, the roller 23 has an outer friction tube 30 which is coated in customary fashion to be suitable for the cloth transportation. The friction tube 30 is centred on the left-hand side on a sliding bush 34, onto which a toothed wheel 36 is pressed. A sleeve 32 is pressed into the interior of the friction tube 30, the said sleeve being provided with a turned groove 31 and being connected in rotationally fixed manner to the friction tube 30 by a notch-like knurling 31'. Pushed in axially is an axle 29, on which, laterally, in each case a spiral spring 37 engages by its inner spring end 38 in an identically denoted shaft slot. The outer spring end 39 engages positively in a slot of the same type in the bore of the sleeve 32. To facilitate mounting, a lock washer 40 is situated on the left-hand side, the lock washer being let peripherally into the sliding bush 34 and the whole arrangement being axially secured.

On the left-hand side, the axle 29 additionally has a ratchet wheel 52, known per se, with brake, the said ratchet wheel blocking the axle 29 on its sliding surfaces 35 during the tensioning of the springs 37. The ratchet wheel 52 can also be used for the distance and/or time limiting.

Situated on the right-hand side of FIG. 2 are identical parts with identical reference numerals, with the addition here in the sliding bush 34 of the slidable bore denoted by 33.

FIG. 3 shows the roller 23 in an end-face view with one toothed wheel 36, the toothed belt 28 being depicted here in addition and a connecting link 45, in the form of a keyway, which is let laterally into the outer wall in the apparatus housing 1, FIG. 1, being evident. The keyway serves for the mounting of the roller 23 and allows the latter to be displaced in axially parallel fashion.

The representation in FIG. 4, a section in the horizontal plane, portrays, by means of its axis of symmetry s, a double construction of the support 26, depicted therebeside, with the lateral roller 20' and a central roller 20.

Here, a yoke plate 41 is riveted on in the interior of the covering 25, the said yoke plate having a guiding slot 50 lying in the horizontal plane, in which a shaft 48 is displaceably mounted. A knurled screw 46 with a concentrically arranged, internal compression spring 47 is screwed, at a thread 44, into a threaded plate 43 fixed in the yoke 41. The compression spring 47 acts on a pressure bush 51, through which the axle 48 is guided. The axle 48 is axially secured laterally by two customary shaft-securing means 49; on the outside there is fitted, a toothed wheel 36, already described above, on which the toothed belt 28 rests. The slidable bearing bore in the yoke 41 is denoted by 42.

It can be seen from FIG. 1, in conjunction with FIG. 4, that the working position of the, altogether, three rollers 20, 20' is adjustable by means of the knurled screws 46, and that this working position is maintained while the strip material 2 is present between the rollers 19 to 21. The axis of symmetry is denoted by s.

If the said towel or strip material 2 is absent, the springs 47 push the rollers 20, 20' inwards in the horizontal plane. This spring excursion is diverted by way of the operative connection 27 to the roller 21 and displaces the roller 23 in the manner previously described, which roller 23, owing to its unloading on the strip material 2', rotates in the anti-clockwise direction and transmits the stored spring energy to the roller 24 by rotation of the friction tube 30 of the roller 23, so that the end region of the towel is drawn in.

So-called watch springs appear to be particularly suitable as the spiral springs 37, since they cannot be overwound in normal operation and reproduce a constant angle of rotation.

It is advisable to wind the spiral springs 37 up as far as they will go by rotation of the roller 23, i.e. to tension them beyond the angle of rotation resulting during threading. This ensures that the strip end 4 is drawn completely into the folding container 14.

The method and the device are of course also applicable to dispensers which are not operated purely manually. It is also possible to dispense with a distance- and/or time-limiting means for the cloth transportation, which is not illustrated here specifically, or to realize it using the great variety of mechanical and/or electrical means.

The lateral supports of the rollers can likewise be resiliently designed, so that the necessary friction on the strip material to be transported is ensured, even when the latter is soaked.

In the further variant of a dispenser according to FIG. 5, a self-contained cassette 60 can be seen in a sectional representation, the said cassette having an outer wall 61 which, by means of suitable passages 1' and **1*b***, at the same time serves as the apparatus housing.

In contrast to FIG. 1, the clean strip material 2 is in this case taken off from the stack 5 at the top in the volume V1 and is deflected by way of the rollers 18' and 21'. Thereafter, it is withdrawn from the slot-like passage **1*b*, and is supplied by way of the passage 1' to the rollers 22 to 24, arranged laterally here, with formation of the loop 3. A roller 26*a*** located at the top serves as the drive.

To prevent soiling by the used strip material, a covering guiding wall 8' is provided here. In addition, sliding rollers 62 are present on the partition 11' to reduce the friction.

In contrast to FIG. 1, a friction block 12' is provided here which, instead of springs, has permanent magnets which bring about a frictional connection in the mutually opposite guiding slots 13, it being necessary for the accummulating strip material 2' to overcome this frictional connection.

This variant can be realized in a simple way as an exchangeable, self-contained cassette 60, the replacement and refilling of the strip material 2' and 2, respectively, advantageously taking place in a laundry.

The further variant of FIG. 6 shows, again in simplified form, a further development with respect to FIG. 5 and represents an improved exemplary embodiment.

A hinged cover la is fastened to an apparatus housing 1, known per se, by way of a hinge **1*c*. Situated in the interior of the housing 1 is a single exchangeable cassette 60, which again contains the two partial volumes V1 and V2. Arranged in the volume V2 is plug-in unit 65 which accommodates the rollers 22 and 24, already described above, which serve to introduce the strip material 2'. At the end face, two toothed wheels 66 are arranged, the latter meshing with one another and causing the two rollers 22 and 24** to move synchronously with one another.

The lowering of the partition 11' takes place here, again automatically, as a result of the stored strip material 2' in the volume V2 by means of a friction block 12' with braking magnet.

Arranged on both longitudinal sides of the plug-in unit 65 are fastening devices 67 which fix a bag-like envelope 14*a* at their opening.

The rollers 19, 20 and 23, already described previously, are fastened to the movable cover 1*a* by their corresponding supports 26, 26' and 26" and act in analogous fashion. The roller 21' is, in view of its greater angle of wrap compared with the roller 21 in FIG. 5, also chosen to be larger.

The cassette 60 has the great advantage that the partial volume V2 can increase at the expense of the volume V1, as a result of the lowering of the bottom plate 11', without soiling arising in the interior of the cassette due to the strip material 2'. The envelope 14*a* consists of polypropylene and can, accordingly, be folded up or dilated, and disposed of without problems.

In FIG. 7, the cassette 60 is illustrated as it appears externally. Again evident are the rollers 22 and 24, by means of which the used strip material 2' is filled into the envelope 14*a*—concealed here—and the strip material 2 guided out of the lower partial volume V1 by way of the roller 21. The roller 21 is laterally mounted in side plates 63 at bearings 74.

The side plates 63 are closed by a corrugation-reinforced sheet in the form of a band-like covering surface 64 for the cassette 60. The covering surface 64 is, at the end faces, let into a corresponding undulating groove in the side plates 63.

To dispense the strip material 2, the covering surface 64 is torn open; the visible end faces of the sheet are denoted by 64'. The strip guidance and the formation of the loop 3 are symbolized by arrows 3.

The whole arrangement is bound by two customary parcel bands 73; to preclude lateral displacements recesses 75 are provided in the side plates 63. Also evident, at the end faces of the two rollers 22 and 24, are the bearings with their centring flange 68 and the end flange 70.

The rollers 22 and 24 can be seen in FIG. 8 inside the self-contained plug-in unit 65 mountable only before the insertion of the cassette. The two fastening devices 67 are illustrated in greater detail here, in which devices the opening of the bag-like envelope 14*a* is fixed simply by being pressed together. Also evident, in a cut-away centring flange 68, are toothed wheels 66.

The plug-in unit 65 is centred inside cassette 60 by its fitting parts 69 and 71, the fitting part 69 being a component of the gearing 72; since the bearings of the rollers 22 and 24 are guided in axially parallel fashion by way of the fastening devices 67 on both sides, any deformations of the cassette 60 do not have an adverse effect.

The production and mounting of the cassettes is simple and requires neither complex equipment nor trained staff, thereby enabling their assembly and maintenance without problems in existing laundries.

It is additionally possible by virtue of the subject matter of the invention to hand over the upkeep of towel dispensers to those renting or purchasing the appliances, without the risk of deterioration of the service.

The components of the above-described invention can be integrated in already existing constructions and enable the improvement thereof.

The manual initiation of the cloth transportation can be effected by pulling on the cloth web directly, but it can also be realized by proximity detectors, etc. and can additionally be linked with other functions, such as the previous drawing of water or the checking of a use authorization.

In practical operation, it has turned out that the overall height of a towel dispenser is to a large degree dependent on the quality of the achieved packing density of the used cloth towel.

The above-described exemplary embodiments with their direct lowering of the bottom achieve only a limited utilization of the partial volume V2, or they achieve the optimum packing density only in ideal circumstances, since the cloth quality of the strip material depends on numerous factors, in particular in the used state. These factors are, besides the type and quality of manufacture of the strip material, its current state (for example after 100 washes), its degree of moisture, its state of creasing, the degree of soiling and, not least, differences in its thickness on account of possible patched and/or joined areas, which are necessary for the economical use of strips of about 30 m in length.

For the purpose of improving the degree of fullness in the volume V2, the lowering of a partition 11' therefore takes place, according to FIGS. 9 and 10, in an indirectly controlled fashion, by way of a spindle drive with a threaded spindle 80, a servomotor 81 and a threaded nut 83.

The servomotor 81 is coupled to the spindle 80 by way of two spur wheels 86, 87, cf. FIG. 10, arranged below a bottom plate 9'. The side plates 63' of the cassette 60' are designed in the previously described manner. Situated thereabove is a movably designed element, a housing lid 95, in which cylindrical rollers 22' and 24', with longitudinal grooves and laterally arranged gearing elements G, G', are mounted. A roller drive 82 is illustrated diagrammatically in FIG. 9 (by chain lines). Situated in the centre, above the housing lid 95, is a microswitch 85, which rests by its operative part on the housing lid 95.

In addition, further guiding elements 13', 13"—realized in a manner known per se—are provided in the side plates 63' and in the cassette 60', the said guiding elements preventing the partition wall 11' from tilting.

The representation of FIG. 10 shows further details of FIG. 9. In particular, a hinge 96 can be seen here which allows opening or pivoting of the housing lid 95. The microswitch 85 is positioned diametrically opposite at the upper side. Also evident is the fact that the roller 24' can be horizontally displaced in its distance from the roller 22' by way of an adjusting screw 88. This serves for adjusting the friction in relation to the strip material 2', not illustrated here, which varies greatly as described above. The partition 11' is laterally guided in mutually opposite guiding slots 13".

In the partial-sectional representation of FIG. 10*a*, the rear wall R of the apparatus housing with the cassette 60' is again evident. The threaded nut 83 only half encloses the spindle 80; it can thus be easily engaged when the cassette is changed. On its side opposite the spindle, it is constructed as a flat slide and is vertically displaceable in the central guiding slot 13'.

The arrangement of the rollers 22' and 24' with their pronounced longitudinal grooves is evident from FIG. 11. Situated in front of the roller 24' is a stripper 91 with a customary longitudinal guide comprising a guiding tab 92 and a pin 92'. The stripper 91 prevents the strip material 2' from "sticking" to the roller 24' and wrapping round the latter.

Furthermore, the adjusting mechanism for the roller 24' is illustrated here in detail: the adjusting screw 88 is in each case guided in a threaded sleeve 89 with a spiral spring 90, so that the roller 24' is able to yield to a certain extent, together with the stripper 91. This is necessary particularly in the case of strip material having seams and/or creases.

The stripper 91, in conjunction with the displaceable and resilient roller 22', increases the operational reliability of the towel dispenser considerably.

The mode of functioning of the movable element, the pivotable housing lid 95, can be seen from FOGS. 12 and 13.

According to FIG. 12, the used strip material 2' is guided in the direction of the arrow by way of the roller 22' and is gripped positively in the fabric by the roller 24', by means of the longitudinal grooves thereof. If the partial volume V2 is empty, the strip material 2' starts to lie in folds upon its introduction, but with increasing filling chaotic folding results, a stack 97 being produced which, as illustrated in FIG. 13, is utilized to establish the degree of fullness, in that the resultant lifting force P pivots the housing lid 95 about the pivot point of the hinge 96.

As soon as a lifting force P, preset by the weight of the housing lid 95, is reached, the resultant displacement is indicated by the microswitch 85 as an electrical signal. The latter acts, in a commonly known fashion, on the servomotor 81 depicted in FIGS. 9 and 10, the rotor of which rotates until the threaded nut 83 and the partition 11' connected thereto have descended by a preset displacement increment.

A further variant is shown in FIG. 14. Instead of a spindle drive, in this case an economically favourable and easy-to-manipulate toothed belt 84 is provided, which brings about the displacement of the partition 11' by way of a driver 98. The toothed belt 84 is vertically guided in a defined manner on its flat part by way of a support plate 94, springs 99 and pressure plates 93. The toothed belt 84 is driven by way of transporting wheels 86', 87', analogously to FIG. 10 by means of a servomotor 81.

The lowering procedure is repeated periodically during use of the towel dispenser, it being possible to achieve an optimum degree of fullness in the volume V2 by this indirect lowering of the partition 11', so that the overall height of a dispenser and of its cassettes can be reduced to a considerable extent.

By incorporating commercially available measuring and controlling elements, further optimization can be achieved in that, for example, the resilient deflection of the stack 97, cf. FIG. 13, during the displacement travel of the partition 11' is taken into account by way of calculation, to bring about a pressing which is dependent on the filling level. Similarly, the filling volume or the amount of clean strip material 2 in the first partial volume V1 could be sensed and utilized to control the partition wall 11, 11' and thus to increase the second partial volume V2.

I claim:

1. A device for carrying out a method for dispensing a flat and absorbent strip of material for hand drying, in which, in an apparatus housing, a first partial volume for receiving and storing a stock of clean, ready-to-use strip material is provided and a second partial volume for receiving used strip material is provided, the two partial volumes are separated from one another by a displaceable partition and the strip material forms a loose loop, the strip material being transferred from the first partial volume, in a manually initiated fashion, at intervals and synchronously into the second partial volume, and the used strip material being transported outside the two partial volumes, on a side facing away from a user, with formation of a loop, characterized in that the displaceable partition is controlled in its position, in dependent on a degree of fullness in the second partial volume, in such a way that the partial volume increases to receive further used strip material and further characterized in that, upon insertion of the strip material, a portion of kinetic energy expended for its transportation is temporarily stored, in that the stock of clean strip material is continuously established and in that, in the absence of a sufficient stock, the stored energy portion is utilized to draw a strip end into the second partial volume, the device being characterized in that at least one roller is arranged in the first partial volume in such a way as to rest on the clean strip material to be displaceable in axially parallel fashion, and in that at least one further roller is provided in the second partial volume in such a way as to rest on the used strip material likewise to be displaceable.

2. Device according to claim 1, characterized in that the rollers displaceable in axially parallel fashion are coupled to one another by way of a double-armed lever or a Bowden cable or a flex ball cable.

3. Device according to claim 1 or 2, characterized in that one roller has a spring energy store which temporarily stores the energy portion.

4. Device according to claim 3, characterized in that there is provided in an interior of the roller at least one spiral spring which engages by its one end in an interior of a sleeve and by its other end in an axle.

5. Device according to claim 4, characterized in that toothed wheels are arranged in both end regions of the axle.

6. A device for carrying out a method for dispensing a flat and absorbent strip material for hand drying, in which, in an apparatus housing, a first partial volume for receiving and storing a stock of clean, ready-to-use strip material is provided and a second partial volume for receiving used strip material is provided, the two partial volumes are separated from one another by a displaceable partition and the strip material forms a loose loop, the strip material being transferred from the first partial volume, in a manually initiated fashion, at intervals and synchronously into the second partial volume, and the used strip material being transported outside the two partial volumes, on a side facing away from a user, with formation of a loop, characterized in that the displaceable partition is controlled in its position, in dependence on a degree of fullness in the second partial volume, in such a way that this partial volume increases to receive further used strip material, the device being characterized in that the strip material is folded at least in one of the first and second partial volumes and there is provided in at least one of the first and second partial volumes a folding container which increases its capacity in accordance with the degree of fullness with strip material.

7. The device of claim 6, wherein the method carried out is further characterized in that upon insertion of the strip material, a portion of kinetic energy expended for its transportation is temporarily stored, in that the stock of clean strip material is continuously established and in that, in the absence of a sufficient stock, the stored energy portion is utilized to draw a strip end into the second partial volume.

8. Device according to claim 6 or 7, characterized in that the folding container rests on a bottom plate which is height-adjustably mounted in at least one guide.

* * * * *